US007926639B2

(12) United States Patent
Moon et al.

(10) Patent No.: US 7,926,639 B2
(45) Date of Patent: Apr. 19, 2011

(54) CASH TRANSACTION MACHINE

(75) Inventors: Sung Jin Moon, Gyeonggi-do (KR); Won Joon Lee, Seoul (KR); Dong Sik Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 469 days.

(21) Appl. No.: 11/967,476

(22) Filed: Dec. 31, 2007

(65) Prior Publication Data

US 2009/0101467 A1 Apr. 23, 2009

(30) Foreign Application Priority Data

Oct. 22, 2007 (KR) ..... 10-2007-0106289

(51) Int. Cl.
*G07F 1/00* (2006.01)

(52) U.S. Cl. ..... 194/351; 194/206; 232/1 D

(58) Field of Classification Search ..... 194/206, 194/207, 344, 350, 351, 353; 209/534; 902/8–17, 902/30–35, 41; 232/1 D, 4 R, 5, 6, 4 D, 7–16
See application file for complete search history.

(56) References Cited

U.S. PATENT DOCUMENTS 5,450,937 A * 9/1995 Ono et al. ..... 194/203
* cited by examiner

*Primary Examiner* — Jeffrey A Shapiro
(74) *Attorney, Agent, or Firm* — Fish & Richardson P.C.

(57) ABSTRACT

A cash transaction machine that can prevent paper media from not being collected due to the wind is provided. The cash transaction machine may provide a mold guide to a dispensing device and provide a bracket to a housing, in order to prevent the paper media from moving backward into the dispensing device due to the strong wind blowing from the outside. Since the mold guide and the bracket are overlappingly coupled with each other, it is possible to prevent the paper media from moving backward into the dispensing device due to the strong wind.

6 Claims, 6 Drawing Sheets

CASH TRANSACTION MACHINE

CROSS-REFERENCE TO RELATED APPLICATION

This application claims priority from Korean Patent Application No. 10-2007-0106289, filed on Oct. 22, 2007, in the Korean Intellectual Property Office, the entire disclosure of which is incorporated herein by reference.

BACKGROUND OF THE INVENTION

1. Field of the Invention

The present invention relates to a cash transaction machine that can prevent paper media from being not collected, and more particularly, to a cash transaction machine that can prevent paper media from being rolled into a dispensing device due to a strong external wind.

2. Description of Related Art

A cash transaction machine denotes an apparatus that a user can deposit or withdraw cash. Without a bank teller or other clerks, the user may use financial services that are provided from a bank or a card company.

The cash transaction machine may have various types of dispensing structures to dispense paper media. For example, a dispensing device may use a scheme of sequentially storing paper media in a cash dispensing portion and opening a shutter. Also, the dispensing device may use a scheme of directly providing the paper media as a bundled unit to the cash dispensing portion without a separate storage. In this instance, the shutter that is positioned in an outlet of the dispensing device may be mechanically connected to an internal gear and may upwardly and downwardly move to be opened and closed.

The cash transaction machine may be installed in a region with strong winds. In the windy region, the user may not collect all paper media that are dispensed from the cash transaction machine. For example, since the shutter and the outlet of the dispensing device are not closely attached to each other, the paper media may be folded by the wind and thereby be stuck between the shutter and the outlet of the dispensing device.

Also, even though the shutter and the outlet of the dispensing device are closely attached to each other, a top paper medium may be closely attached to a top surface of the outlet by the strong wind and thereby the user may not notice the top paper medium. Also, depending on cases, since the wind blows too strongly, a portion of the paper media may be rolled into the dispensing device.

SUMMARY OF THE INVENTION

An aspect of the present invention also provides a cash transaction machine that can prevent paper media from being not collected from a cash transaction machine due to external elements such as wind.

Another aspect of the present invention also provides a cash transaction machine that can prevent paper media from being rolled into a dispensing device due to external elements such as wind.

According to an aspect of the present invention, there is provided a cash transaction machine including: a housing including an outlet that dispenses a paper medium; and a dispensing device comprising a transfer section that transfers the paper medium to the outlet and a mold guide that is located in an end of the transfer section adjacent to the outlet and is extended toward the outlet rather than the end of the transfer section.

In an aspect of the present invention, the dispensing device may be included in the housing corresponding to the outlet of the housing to dispense paper media. The transfer section may transfer the paper media from a paper media storage section to the end of the outlet. Also, a shutter may be provided to prevent an external access to the outlet. The shutter may be installed in the housing or the end of the dispensing device.

The transfer section may transfer the paper media using a roller and a belt. Also, the transfer may transfer the paper media using a roller and a guide plate. Also, the transfer section may transfer the paper media using both schemes. Specifically, the transfer section may include the roller to directly or indirectly contact with the paper media. A mold guide may be provided on a roller axis of the roller. Also, at least one or two mold guides may be provided to the roller axis to be disposed between the rollers.

Even though the paper media are pressed by the rollers, the paper media may be rolled into the dispensing device due to the strong wind. However, in an aspect of the present invention, when the pressure by the roller is maintained to greater than or equal to a predetermined level, it is possible to prevent the paper media from moving backward due to the wind and the like.

In this instance, the mold guide may be externally extended toward the outside rather than the end of the transfer section. Specifically, the mold guide may be provided adjacent to the outlet rather than the transfer section to thereby prevent the paper media from easily being folded. Also, when the strong wind blows into the cash transaction machine from the outside, the paper media may be folded between rollers that are positioned in the end of the transfer section. However, since the externally extended mold guide is provided, it is possible to prevent the paper media from being folded in a half between a first roller and a second roller.

The mold guide may be provided on either an upper portion or a lower portion of the transfer section based on the travel route of the transfer section, that is, on any one or both of the upper portion and the lower portion. Also, the mold guide may be provided between rollers, or on one side of the roller.

The housing may further include a bracket of which one end is fixed around the outlet of the housing and another end is overlapped with the end of the mold guide. Specifically, the bracket may connect the outlet and the mold guide. The bracket may be provided to cross the mold guide when the dispensing device closely contacts with the outlet. Also, the bracket may be formed in an L-shape toward the mold guide and may be overlappingly coupled with the mold guide.

The bracket may include a bracket groove that receives an end of the mold guide. The bracket groove is formed toward the outside from a location where the mold guide is coupled with the bracket. The bracket groove may partially receive an end of the mold guide. The bracket groove may include a groove that makes the mold guide communicate with the bracket. The mold guide and the bracket may be overlappingly crossed in such a manner that the bracket groove partially receives the mold guide.

Also, the housing may further include a bending cap. The bending cap may be externally protruded from the housing. For example, the bending cap may be externally curved from the housing.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS

Figure 1:
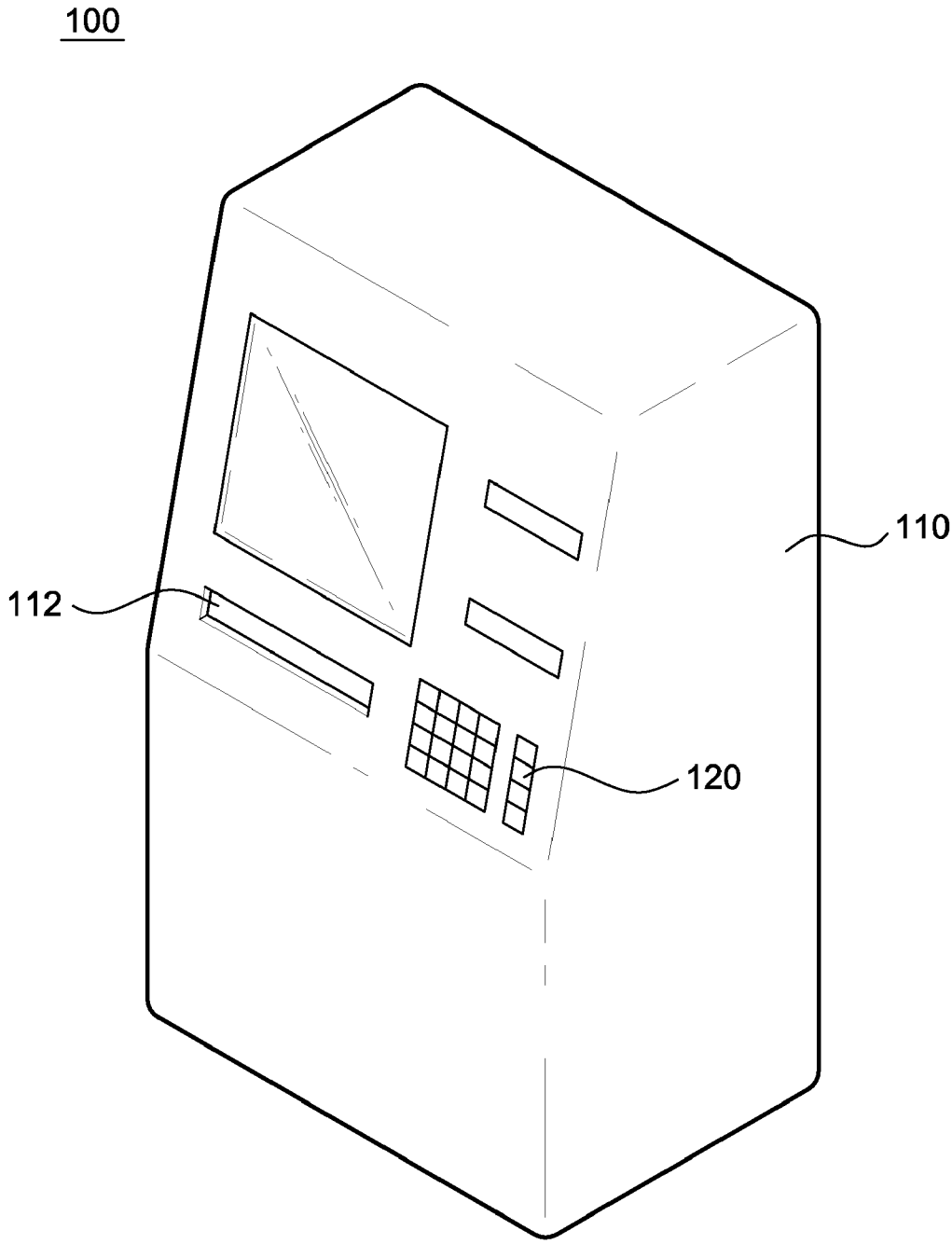
FIG. 1 is a perspective view illustrating a cash transaction machine according to an exemplary embodiment of the present invention.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

FIG. 1 is a perspective view illustrating a cash transaction machine 100 according to an exemplary embodiment of the present invention.

Referring to FIG. 1, the cash transaction machine 100 may include a housing 110 for protecting an external appearance and a dispensing device for dispensing money. More specifically, in addition to the housing 110 and the dispensing device 130, the cash transaction machine 100 may selectively include a main controller, a depositing device, a card reader, a bankbook updating device, a check depositing/dispensing device, and the like.

In the present exemplary embodiment, a paper medium generally denotes paper money. In addition to paper money, the paper medium may denote a check, a gift certificate, a ticket, and the like. The present invention is not limited to or restricted by the type, the shape, and the size of the paper medium.

As shown in FIG. 1, the housing 110 may include a shutter 112, a manipulation portion 120, and the like. The paper medium may be received or dispensed using the shutter 112 depending on a user demand. In this instance, the shutter 112 may face an outlet that is formed in an end of the dispensing device 130. The outlet 140 will be described later. The paper medium that is transferred from the dispensing device 130 may be guided to a user via the shutter 112 and the outlet 140.

Also, the manipulation portion 120 may be electrically connected to an internal controller, formed in a body, to enable the cash transaction machine 100 to be operated by the manipulation of the user. In this case, the shutter 112 functions to enable reception or dispensing of paper money and the like depending on the manipulation of the user on the manipulation portion 160.

Figure 2:
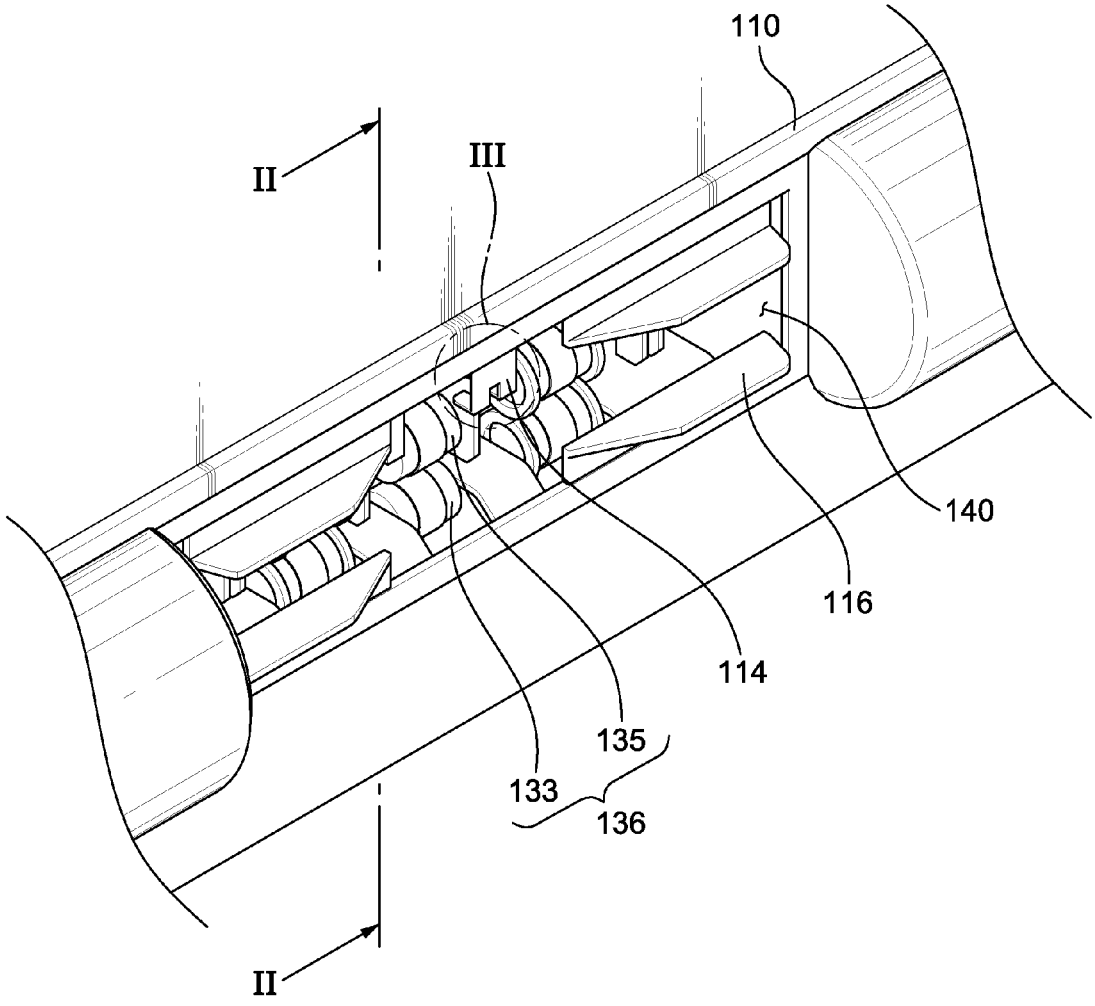
FIG. 2 is a partial perspective view illustrating a dispensing device contacting with a shutter of the cash transaction machine.
Figure 3:
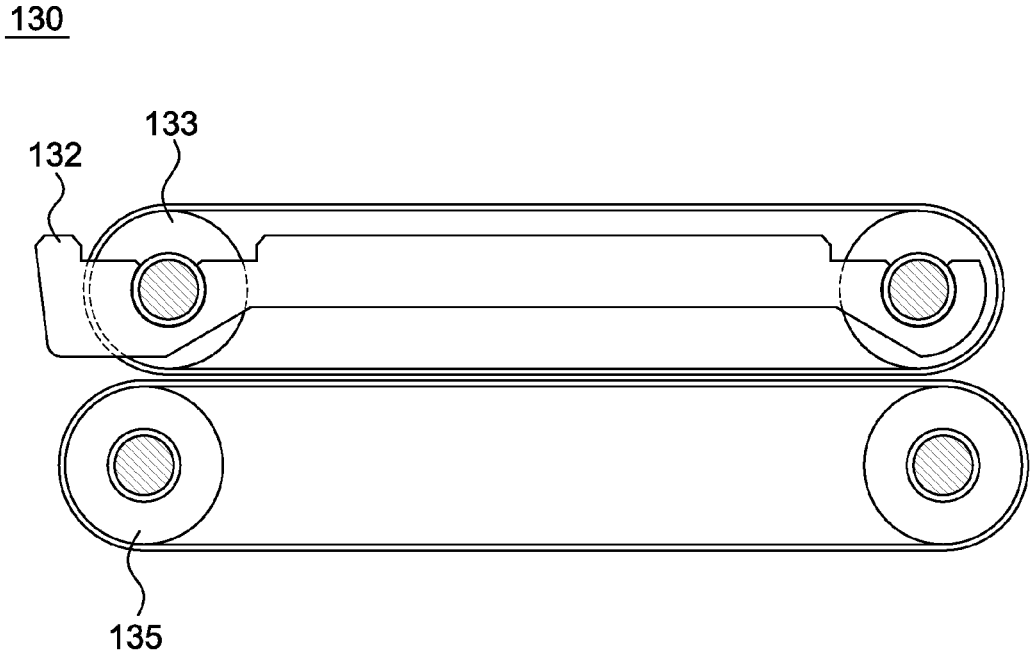
FIG. 3 is a cross-sectional view illustrating a cross-section at line II-II of FIG. 2.
Figure 4A:
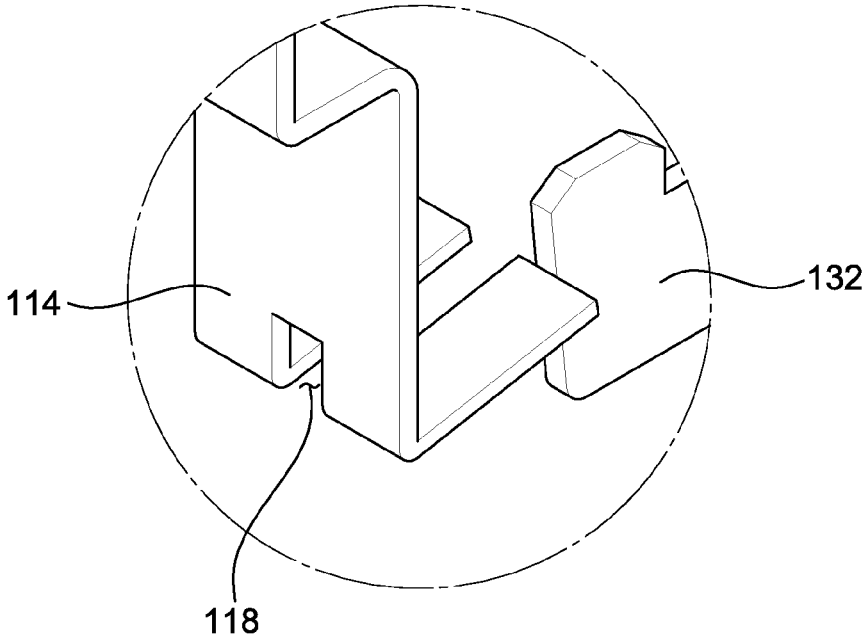
FIGS. 4A and 4B are enlarged perspective views illustrating a region III of FIG. 2.
Figure 4B:
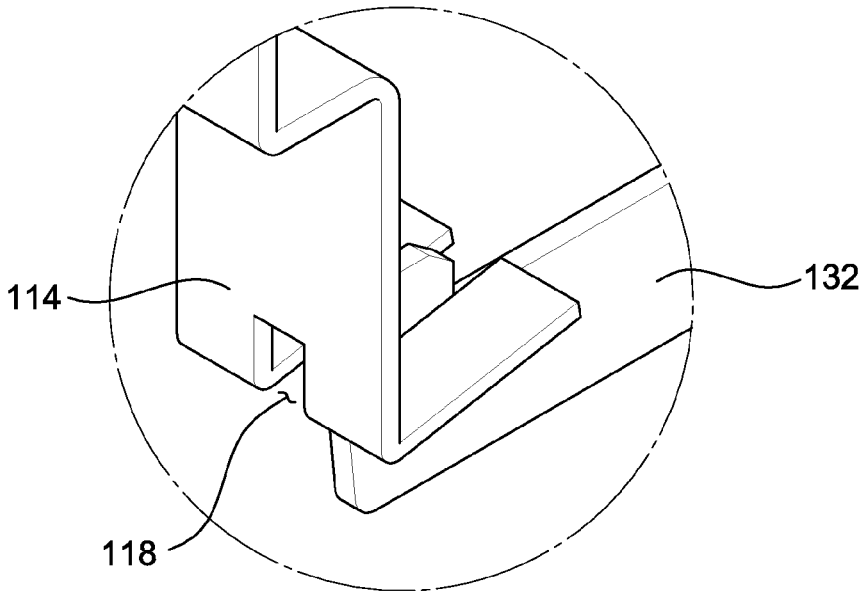

FIG. 2 is a partial perspective view illustrating the dispensing device contacting with the shutter 112 of the cash transaction machine 100, FIG. 3 is a cross-sectional view illustrating cross-section at a line II-II of FIG. 2, and FIGS. 4A and 4B are enlarged perspective views illustrating a region III of FIG. 2.

Referring to FIGS. 2 and 4, the shutter 112 of the cash transaction machine 100 may closely contact with the dispensing device 130. The dispensing device 130 may include a transfer section 136 that guides dispensing of the paper medium according to the user demand. The transfer section 136 may include rollers to press the paper medium.

The transfer section 136 may include a first roller 133 and a second roller 135. The first roller 133 and the second roller 135 function to transfer the paper medium via a belt. Also, the first roller 133 and the second roller 135 may press the paper medium with a predetermined level of pressure and thereby fix the paper medium to not be separated from the dispensing device 130. As described above, when the pressure by the first roller 133 and the second roller 135 is too weak, a portion of the paper medium 130 may be rolled into the dispensing device 130 due to the wind. Conversely, when the pressure by the first roller 133 and the second roller 135 is too strong, the user may not readily collect the paper medium. Also, the paper medium may not lift the roller section 136 and thereby a jammed situation may occur. In this instance, when the first roller 133 and the second roller 135 press the paper medium with more than or equal to a predetermined level of pressure from top and bottom, it is possible to prevent the paper medium from being rolled into a space between the first roller 133 and the second roller 135. According to another exemplary embodiment of the present invention, the roller pressure to press the paper medium may be changed depending on a required condition, a design specification, and the like.

Referring to FIGS. 3, 4A, and 4B, the dispensing device 130 may include a mold guide 132. The mold guide 132 may be provided adjacent to an outlet rather than an end of the transfer section 136. The mold guide 132 may be provided in an upper portion or a lower portion based on a travel route of the transfer section 136. Also, the mold guide may be provided on the side of the transfer section 136. In this instance, the paper medium passes through the transfer section 136. Also, the mold guide 132 may be fixed to the side of the transfer section 136. In the present exemplary embodiment of the present invention, the mold guide 132 is provided on a roller axis of the first roller 133. However, the present invention is not limited thereto.

The mold guide 132 is extended toward an outside rather than the end of the transfer section 136. Therefore, it is possible to initially prevent the paper medium from being folded in a half and thereby being rolled into the dispensing device 130 due to the external wind blowing into the cash transaction machine 100. Specifically, the paper medium may initially collide with the mold guide 132 prior to being folded in a half. Therefore, the mold guide 132 may prevent the paper medium from being rolled into the dispensing device 130 due to the wind. Also, it is possible to prevent the paper medium from moving backward between the housing 110 and the dispensing device 130.

The mold guide 132 may be provided adjacent to the roller. For example, the mold guide 132 may include a hole to be fixed to the roller axis of the first roller 133. According to the present exemplary embodiment, the mold guide 132 is fixed on the roller axis of the first roller 133 and the second roller 135 and thereby moves upwardly and downwardly together with the first roller 133 and the second roller 135. According to another exemplary embodiment of the present invention, the mold guide 132 may be fixed to another structure instead of the roller axis and may not move in interoperation with the upward and downward movement of the first roller 133 and the second roller 135. The present invention is not limited to or restricted by a scheme of fixing the mold guide 132 to the first roller 133 and the second roller 135, a material, and the like.

The housing 110 may include a bracket 114 that is coupled with the mold guide 132. One end of the bracket 114 may be fixed around an outlet 140 of the housing 110 and another end of the bracket 114 may be overlapped with an end of the mold guide 132. Specifically, the bracket 114 may connect the outlet 140 and the mold guide 132. The bracket 114 may be provided to cross or intersect the mold guide 132 when the dispensing device 130 closely contacts with the outlet 140. Specifically, the bracket 114 may be formed in an L-shape toward the mold guide 132 and may be overlappingly coupled with the mold guide 132.

Since the bracket 114 is overlappingly coupled with the mold guide 132, it is possible to prevent the paper medium from being rolled between the housing 110 and the dispensing device 130. Also, the bracket 114 may include a curved groove that receives the end of the shutter 112. The curved groove 115 may be curved and formed in an L-shape or a W-shape. The shutter 112 will be described later. Also, the present invention is not limited to or restricted by the shape of the curved groove 115 and the like.

The bracket 114 may be formed in a region corresponding to the mold guide 132 in order to be coupled with the mold guide 132. Specifically, as shown in the figures, the bracket 114 may be provided in the upper portion of the housing 110 in correspondence to the mold guide 132. Also, the bracket 114 may be provided in the lower portion, or in both the upper and the lower portions of the housing 110. As described above, in the present exemplary embodiment of the present invention, the bracket 114 is formed in the L-shape. However, the present invention is not limited to or restricted by the shape of the bracket 114.

When the bracket 114 is provided in a location enabling operation of the dispensing device 130 in the housing 110, the bracket 114 may be coupled with the mold guide 132. Referring to FIGS. 4A and 4B, when the housing 110 and the dispensing device 130 do not closely contact with each other, there is a gap between the bracket 114 and the mold guide 132. However, when the end of the dispensing device 130 is exposed from the outlet 140 of the housing 110 and thereby is provided, the bracket 114 may be coupled with the mold guide 132. The bracket 114 and the mold guide 132 are coupled with each other around the outlet 140 and may be overlappingly coupled with each other by a bracket groove 118. The bracket groove 118 will be described later.

The bracket 114 may include the bracket groove 118 to be overlapped with the mold guide 132. The bracket groove 118 may be extended towards the housing 110 from a location where the bracket 114 is initially coupled with the mold guide 132.

Referring again to FIGS. 4A and 4B, the bracket groove 118 may be formed in the same shape as the bracket 114 to enable the mold guide 132 to pass through the bracket 114. The bracket groove 114 may be formed in a center of the bracket 114. The bracket groove 118 may be formed in various types of shapes to enable the mold guide 132 to pass through the bracket 114. For example, the bracket groove 118 may be formed in a location separated from the center of the bracket 114. The bracket groove 118 may change based on the moving range of the mold guide 132, a required condition, and the like. The present invention is not limited to or restricted thereby.

The housing 110 may include a bending cap that is externally protruded from the housing 110. The bending cap 116 may be externally folded on an external surface of the outlet 140 of the housing 110. The bending cap 116 may be formed of a plastic, a metal, and the like. The bending cap 116 may be integrally formed with the housing 110. Also, the bending cap 116 may be externally bent at about 90 degrees based on the housing 110. In this case, it may be possible to prevent the paper medium from being folded in a half and moving into the housing 110 due to the wind. Also, it may be possible to prevent a top paper medium from being too closely attached on the outlet 140 and thereby making the user not notice the top paper medium. Also, the bending cap 116 may be provided in the upper portion or the lower portion, or both the upper and the lower portions of the housing 110. Preferably, the bending cap 116 may be provided in each of the upper and the lower portions of the housing 110.

Figure 5:
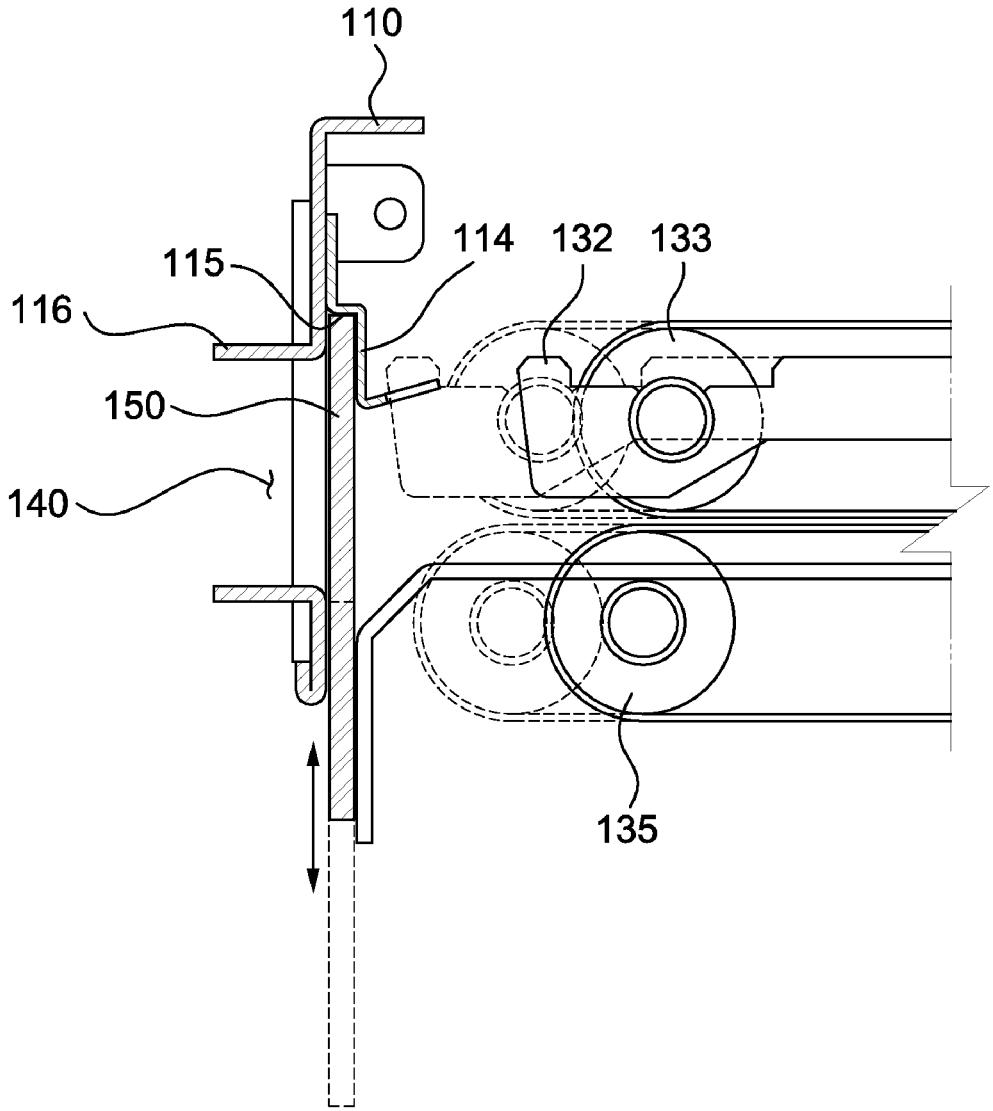
FIG. 5 is a cross-sectional view illustrating an attaching relation between a dispensing device and a housing along the line II-II of FIG. 2.
Figure 6:
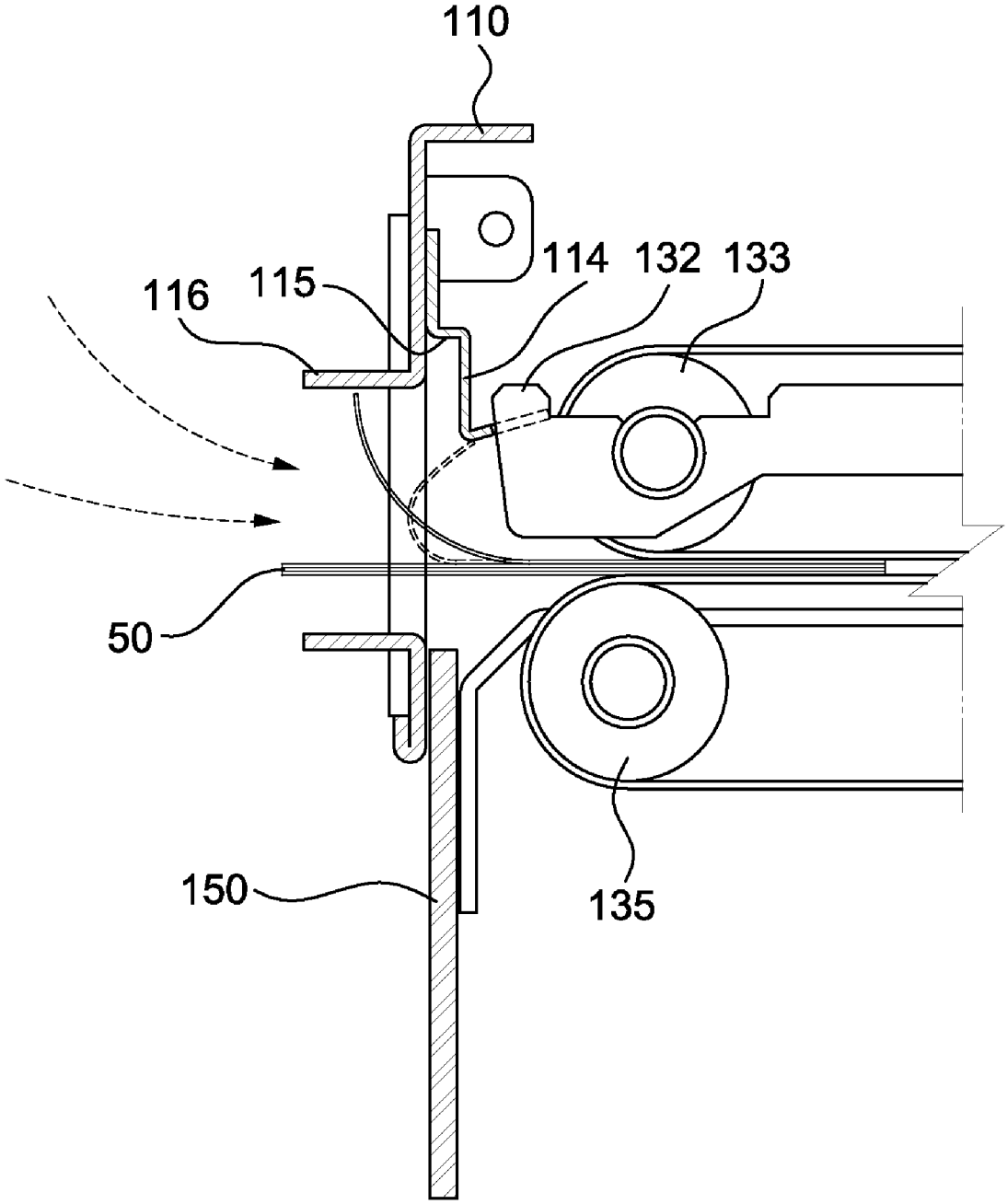
FIG. 6 is a cross-sectional view for describing that the dispensing device and the housing are closely attached to thereby prevent paper media from moving backward into the dispensing device.

FIG. 5 is a cross-sectional view illustrating an attaching relation between the dispensing device 130 and the housing 110 along the line II-II of FIG. 2, and FIG. 6 is a cross-sectional view for describing that the dispensing device 130 and the housing 110 are closely attached to thereby prevent paper media from moving backward into the dispensing device.

Referring to FIGS. 5 and 6, the dispensing device 130 that is included in the cash transaction machine 100 may move to closely contact with the housing 110 by the manipulation of a user. When the dispensing device 130 is attached to the housing 110, the bracket 114 and the mold guide 132 may be overlappingly coupled with each other.

As described above, the coupled bracket 114 and the mold guide 132 may prevent the paper medium from being folded in a half and moving backward in the dispensing device 130 due to the strong wind blowing from an outside of the card transaction machine 100. For example, when the housing 110 and the dispensing device 130 are closely attached to each other and in this instance, the paper medium is dispensed, the paper medium may be folded in half and be rolled into the dispensing device 130 due to the strong wind. However, the bracket 114 and the mold guide 132 may collide with the folded paper medium and thereby prevent the paper medium from being rolled into the dispensing device 130.

The bracket 114 may include the curved groove 115 that may receive the end of the shutter 112. For example, when the paper medium is not dispensed, the shutter 112 may separate inside and outside of the cash transaction machine 100. Specifically, the shutter 112 may be received in the curved groove 115 and thereby prevent the inside of the cash transaction machine 112 from being exposed. The curved groove 115 may be formed in the same width and the shape as the end of the shutter 112. The width, the shape, and the like may be variously modified based on the required condition, the design specification, and the like.

Also, the bending cap 116 that is disposed in the housing 110 may prevent the case where the paper medium is closely attached to the housing 110 causing the user to not notice the attached paper medium. Specifically, it is possible to prevent the user from not collecting the paper medium that is closely attached to the housing 10 and thus is temporarily inconspicuous. Also, the bending cap 116 may prevent the paper medium from being rolled into a space due to the strong wind blowing from an outside. Therefore, it is possible to prevent the user from not collecting the paper medium in various aspects. The bending cap 116 may be externally protruded to some extents and may be formed in various shapes. The present invention is not limited to or restricted by the length, the shape, and the like of the bending cap 116. In the present exemplary embodiment, the shutter 112 is disposed in an inner side of the bending cap 116 to enable opening and closing of the outlet 140 while moving up and down.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A cash transaction machine comprising:

a housing including an outlet that dispenses a paper medium;

a dispensing device comprising a transfer section that transfers the paper medium to the outlet and a mold guide that is located in an end of the transfer section adjacent to the outlet and is extended toward the outlet rather than the end of the transfer section and parallel to a travel route of the transfer section; and a bracket of which one end is fixed around the outlet of the housing and another end is overlapped with the end of the mold guide, wherein the mold guide is provided in an upper portion and/or a lower portion of the end of the transfer section based on the travel route, wherein the bracket fills a gap between the outlet and the mold guide, and wherein the bracket comprises a bracket groove that receives an end of the mold guide.

2. The cash transaction machine of claim 1, wherein the transfer section includes a roller in an end of the outlet, and the mold guide is mounted to a rotation axis of the roller.

3. The cash transaction machine of claim 1, wherein the housing further comprises a bending cap that is provided in the outlet and the bending cap is curved toward an outside of the housing.

4. A cash transaction machine comprising:

a housing including an outlet that dispenses a paper medium;

a dispensing device comprising a transfer section that transfers the paper medium to the outlet and a mold guide that is located in an end of the transfer section adjacent to the outlet and is extended toward the outlet rather than the end of the transfer section and parallel to a travel route of the transfer section; and a bracket of which one end is fixed around the outlet of the housing and another end is overlapped with the end of the mold guide, wherein the mold guide is provided in an upper portion and/or a lower portion of the end of the transfer section based on the travel route, wherein the bracket fills a gap between the outlet and the mold guide, and wherein the bracket further comprises a curved groove that receives an end of a shutter.

5. The cash transaction machine of claim 4, wherein the transfer section includes a roller in an end of the outlet, and the mold guide is mounted to a rotation axis of the roller.

6. The cash transaction machine of claim 4, wherein the housing further comprises a bending cap that is provided in the outlet and the bending cap is curved toward an outside of the housing.

* * * * *